United States Patent [19]

Tsukumo

[11] 4,187,588

[45] Feb. 12, 1980

[54] CONSTRUCTION OF PENDULUM ARM TYPE HIGH SENSITIVITY SELF-ALIGNING WEIGHTING ARM

[75] Inventor: Zenzaburo Tsukumo, Ikeda, Japan

[73] Assignees: NTN Toyo Bearing Co. Ltd.; Zenzaburo Tsukumo, both of Osaka, Japan

[21] Appl. No.: 882,221

[22] Filed: Feb. 28, 1978

Related U.S. Application Data

[63] Continuation of Ser. No. 754,890, Dec. 27, 1976, abandoned.

[30] Foreign Application Priority Data

Dec. 26, 1975 [DE] Fed. Rep. of Germany ..... 50157034

[51] Int. Cl.[2] ..... D01H 5/50

[52] U.S. Cl. ..... 19/281; 19/295

[58] Field of Search ..... 19/266, 267, 278–282, 19/294, 295, 272

[56] References Cited

U.S. PATENT DOCUMENTS

| | | | |
|---|---|---|---|
| 2,657,434 | 11/1953 | Tarbox et al. | 19/280 X |
| 2,787,025 | 4/1957 | Solanas | 19/280 |
| 3,041,677 | 7/1962 | Butler | 19/277 X |
| 3,663,992 | 5/1972 | Ooki et al. | 19/281 |

FOREIGN PATENT DOCUMENTS

| | | | |
|---|---|---|---|
| 1066921 | 10/1959 | Fed. Rep. of Germany | 19/281 |

*Primary Examiner*—Louis Rimrodt

*Attorney, Agent, or Firm*—Hall & Houghton

[57] ABSTRACT

A pendulum arm type high sensitivity self-aligning weighting arm includes a press assembly for pressing a driven body consisting of a roller body against a driving body such as a roller body or a belt body, wherein one end of the press assembly which has the function of holding and pressing the driven body and which provides a fulcrum for the weighting arm is supported in such a manner as to be capable of executing three motions, pitching, yawing and rolling, that is, it is supported in a pivot fashion, while the other end holds a rotatable roll shaft on the driven body side. The weighting arm is characterized in that a rolling-contact bearing element is interposed in a region of contact between the press assembly using a compression spring, compressed air or other fluid pressure for pressing the weighting arm, and the weighting arm through a cap.

7 Claims, 50 Drawing Figures

PRIOR ART

PRIOR ART
Fig 8
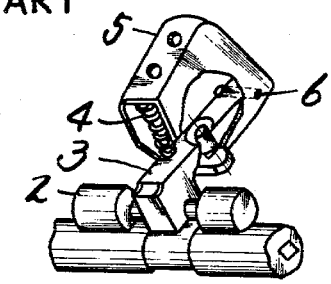
Fig 9
PRIOR ART
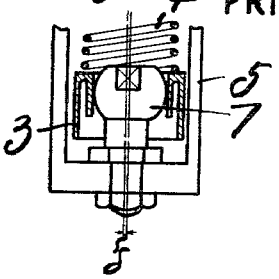
Fig 10
PRIOR ART
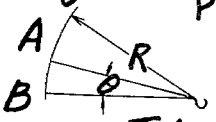
PRIOR ART
Fig 13A
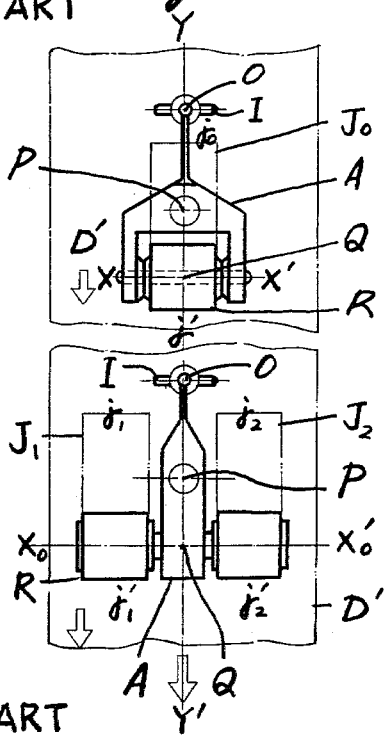
PRIOR ART
Fig 13B
Fig 14
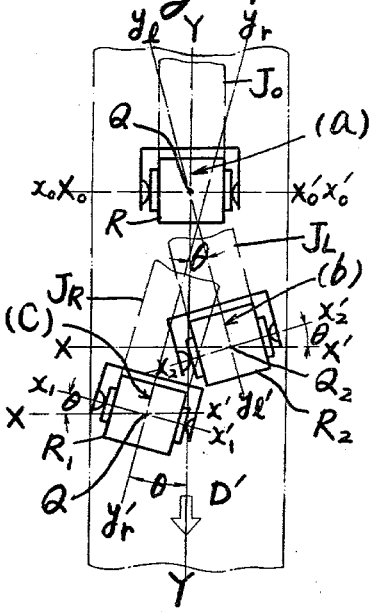

Fig 17A
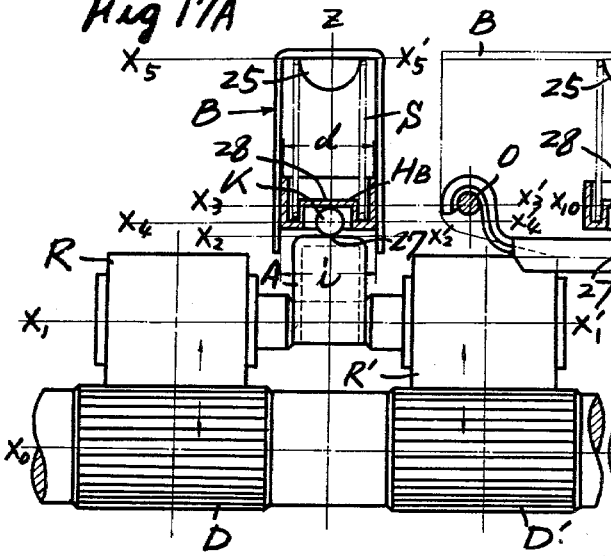
Fig 17B
Fig 18A
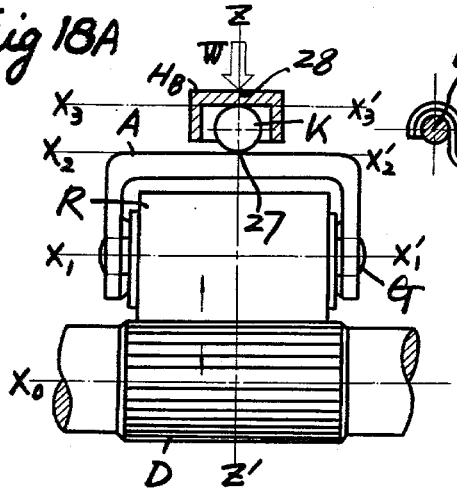
Fig 18B
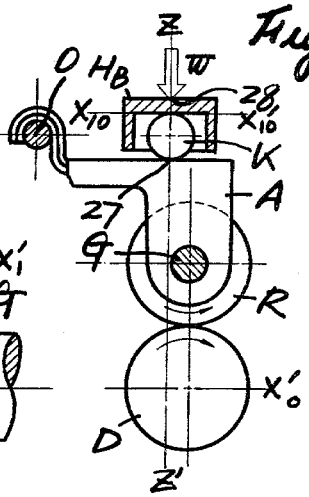

Z
Z'
X
X'
25
B
S
28
$H_B$
K
R
R'
h
M
A
Δδ
27
Q
P
O
W
D

Fig 23A
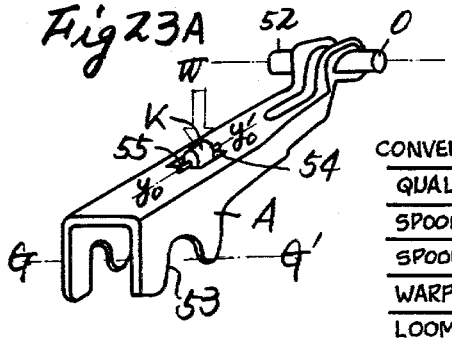
Fig 23B
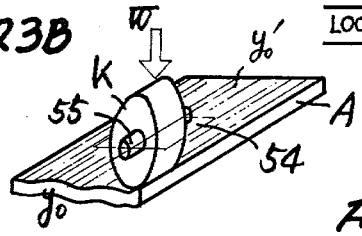
Fig 25
| QUALITY ITEM | CONVENTIONAL WTG. SYST. | IMP'D WTG. SYSTEM | RATE OF IMPROVEMENT |
|---|---|---|---|
| SPOOLER (A) | 70.0 | 47.6 | 20% ↓ |
| SPOOLER (B) | 8.8 | 11.9 | 35% ↑ |
| WARPER (C) | 7.2 | 4.2 | 40% ↓ |
| LOOM (D) | 0.71 | 0.41 | 40% ↓ |
| LOOM EFFIENCY(E) | 0.385 | 0.405 | 5% ↑ |
A) YARN BREAKAGE %
B) AM'T. PROD'D / SPINDLE (1HS./DAY)
C) NO. OF YARN BRKS. /1000 YARNS/1000 YDS.
D) NO. OF WARP BRKS. / LOOM/HR.
E) NO. TAN (ABOUT 12YDS. / DAY/LOOM
Fig 24
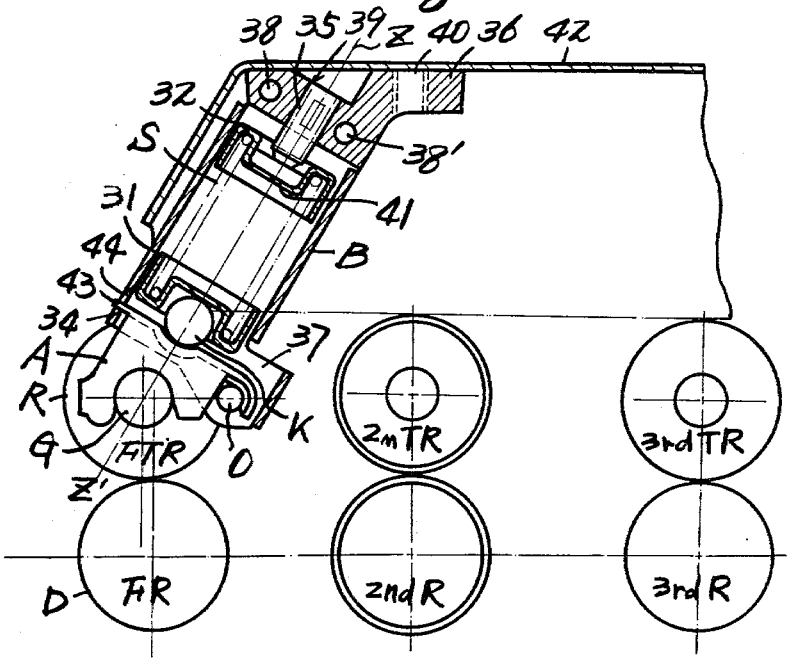

CONSTRUCTION OF PENDULUM ARM TYPE HIGH SENSITIVITY SELF-ALIGNING WEIGHTING ARM

This is a continuation of application Ser. No. 754,890 filed Dec. 27, 1976, now abandoned.

BRIEF DESCRIPTION OF THE INVENTION (a) Field of the Invention

The present invention relates to a self-aligning type weighting arm for use with a top roller holding and pressing device which is important in forming a nip for draft operation in textile machines including drawing frames, flyer frames and spinning frames.

(b) Description of the Prior Art

In general, a pendulum arm type weighting arm having a self-aligning action which is in wide use, as shown in FIGS. 1 and 2, comprises a weighting arm A, a guide arm case B, a guide arm pin C, a driving body D, driven rollers R, a driven roller shaft G, and a press body S.

Usually, the draft section of a textile machine comprises two or more pairs of parallel disposed assemblies described above, and in each such pair the top roller R on the driven side is rotated as pressed against the bottom roller D on the driving side while maintaining a cylindrical contact relation and forming a pressure nip in various forms including point, line and surface contact depending upon the quality of parallelism of the axes of the top and bottom rollers. For the textile machine draft section, highly stabilized surface contact is an essential condition for improved yarn quality. More particularly, if the parallelism between the axes of the top and bottom rollers R and D is impaired, this causes an unstable change in their contact condition, bringing them into a point or line contact condition, which means that the stable pressure nip cannot be maintained and hence it is difficult to obtain a smooth and stable draft action, resulting in a direct adverse effect on the quality of the product. Therefore, maintaining the parallelism of the axes of the bottom and top rollers D and r has been an indispensable condition of the draft section of textile machines. Conventionally, measures taken to meet this condition have been to maximize the degree of accuracy of the guide arm A and weighting arm, to make adjustments during assembly or to resort to self-alignment. It is under always-parallel conditions that the rollers continue to form a roller nip with a uniform pressure distribution over the entire area of contact while executing pressure contact rotation. This device has a tendency to produce an unstable condition as it is subjected to the influence of a complex motion such as yawing, rolling and pitching due to the arrangement of the weighting arm A. Particularly in the case of FIG. 1 wherein the driven roller R and the driving roller D contact each other along a cylindrical surface, depending upon the quality of parallelism of their axes, their contact condition presents various forms, producing a very unstable nip in connection with pressing.

In brief, the draft section requires a stable and secure nip. Further, it is important to maintain a strong nip condition uniformly distributed over the entire width of the contact region. More particularly, if the parallelism between the axes of the top and bottom rollers R and D is impaired, this produces an unstable change in the nip condition of the rollers, with the pressure contact condition changing its linear form into one resembling a point, thereby making it difficult to obtain a uniformly pressed nip condition stabilized widthwise of the rollers. FIG. 3 shows deviated conditions associated with a self-aligning mechanism corresponding to FIG. 1, wherein a designates a normal condition and b and c designate abnormal conditions deviated to either side. When measured at a job site, it is found that in most case either a or b predomintes. The maintenance of the parallelism of the axes of the driven roller and the driving body is a subject of utmost importance. No sufficient approach to meet this condition has been established. Heretofore, there has been no choice but to maximize the degree of accuracy of the components of the guide arm and weighting arm, repair or adjust them during assembly while taking much time, or resort to a self-aligning mechanism of the conventional type though not very satisfactory. These approaches, however, have their limitations. In order to meet the needs of the market, it is necessary to no longer rely on the conventional systems which are at a deadlock and instead to invent a novel weighting arm construction of high sensitivity. Such demand has led to various types of weighting constructions.

The weighting arms actually employed at job sites may be classified into the following three types.

SELF-CENTERING TYPES (PENDULUM TYPE)

This type, as shown in FIGS. 4A and 4B, is based on the principle of employing a pivot construction with the axis of the swing motion of a conventional pendulum type guide arm 3 located at a pin 6, whereby the guide arm is supported for rotation in the vertical and horizontal direction or yawing direction, wherein a top roller 2 is rotated by a bottom roller 1, thereby automatically adjusting the parallelism of the top roller 2 with respect to the bottom roller 2. The numeral 4 designates a spring; 5, a guide arm case; and 7 designates the body of the arm. Thus, this type is based on the principle of the pendulum found in the centrally directed restoration action of two freely rotatable wheels in the case where said wheels are symmetrically arranged while a pendulum arm holding their shaft at its midpoint is disposed at right angles with the shaft and has its fulcrum located on an extension thereof. The restoration action is based on the production of thrust due to alignment and there is no denying this fact, but the influences of cumulative error due to various factors connected with manufacture including deviation of the spring, deviation of the guide arm case, deviation of the arm body, and errors in the holding part are noticeable. Particularly, the recent demand for increased weighting has a marked tendency to increase the causes of deviation because of the nature of the surface of contact between the top and bottom rollers. It is the second back roller and the following having lower rpm that are particularly greatly subjected to said causes of errors. In these parts, the restoration force (thrust force) is so small that there is produced no sufficient force to accommodate said cumulative error. Therefore, under these circumstances, the part having lower rpm having been remodeled into a pendulum form has resulted in interfering with the maintenance of the parallelism of the top roller relative to the bottom roller. Further, improving the draft performance of the draft section is the demand of the times, and it is an indispensable factor to increase the nip pressure. However, the increase in the pressure on the top roller in the cylinder-on-cylinder arrangement becomes a cause of aggravating the parallelism of the bottom and top rollers. Therefore, there is a limit to the self-alignment based on the pendulum type for increasing pressure, and at present it is used beyond its limit. particularly in the second roller and the following having lower rpm, there is the drawback that this tendency toward deviation is pronounced. (See FIGS. 5 and 6.) It has been proved that the adverse effect of relying on self-alignment on recent flyer frames using low rpm and high weighting pressure leads to the lowering of the performance of the fiber draft section and that self-alignment has reached its limit in improving quality. As a countermeasure thereagainst, a method is sometimes employed in which a guide piece (not shown) is attached to the guide arm for correction purposes, but it is practically impossible to maintain the required accuracy.

FIXED TYPE

This method is shown in FIGS. 7A and 7B. FIG. 7A, shows a system not relying on self-alignment, wherein the part for holding the arbor of the top rollers pressed by a pressure is directly held at a right angle by a guide arm 3 in such a manner as to be capable of two motions, yawing and rolling. In this system, the guide arm 3 itself is fixed to the arm body 9. Designated at 11 is a set screw and 12 is a spring-anchoring pin. The arrangement shown in FIG. 7B, resembles that shown in FIG. 7A. In order to prevent the concomitant lowering of the pressure on the top roller due to frictional resistance at the part for holding the top roller of the guide arm, which is the drawback of the FIG. 7A, type, a guide arm pin 10 is proviced. As described above, the fixed type is the guide arm type using heavy weighting system attempted to eliminate the drawbacks of the pendulum system and in recent years there has been a tendency for those belonging to this type to increase. It is impossible to obtain satisfactory results unless the arm body is at a true right angle with the bottom roller and unless all the components of the guide arm have very high manufacturing accuracy. As in the pendulum system, cumulative error is produced, widening the range of scatter more than expected. In this case also, the cumulative error is not very different from that in the case of the above described pendulum system. Though theoretically possible, as in the pendulum system, practically it is very difficult to maintain the parallelism of the top and bottom rollers. It must be frankly admitted that both the pendulum arm type and the fixed type have serious drawbacks with respect to self-alignment performance, as described above.

This is fully endorsed by the following investigation results obtained at job sites. Thus, FIG. 5 shows the degree of deviation of the back top roller in the pendulum arm system and in the fixed system, and similarly FIG. 6 shows the degree of deviation of the front top roller in said two systems. In each case, the data was obtained at big firms on the basis of a strict sampling method. Considered from this data, it is clearly seen that although the self-aligning type weighting arm is a little more a advantageous, the deviation scatters over a wide range beyond the allowable limits (range irrelevant to the occurrence of yarn unevenness). There is no denying that for firms which manage a very large number of groups, it is no easy task to maintain the top roller in allowable conditions.

Considered from this, it should be said that basic investigation for a high sensitivity self-aligning construction having a maintenance-free capability is of urgent necessity.

The structural drawbacks of the weighting arm cannot be easily eliminated, as described above, but this does not necessarily mean that there is no perfect measure at all. The adjustment type to be described below belongs to a sure measure.

ADJUSTMENT TYPE

According to the adjustment type disclosed in Japanese Patent Application No. 117330/72 (Patent Opening No. 72422/74), it is possible to eliminate the direct drawbacks. FIGS. 8–10 show an example of the adjustment system. According to this adjustment system, in the draft section of a textile machine, the top roller is fixedly held by one end of the weighting arm (guide arm), the other end being supported in a pivot fashion to constitute the pendulum system, while separately from the guide arm, the guide arm case or a separately fixed deviation adjusting spherical element is brought into spherical surface contact with a portion of the guide arm in a free condition with respect to the guide arm so as to enable the yawing motion of the top roller to be adjusted and controlled, thereby maintaining the axis of the top roller parallel with the axis of the bottom roller and at the same time allowing the pitching motion and rolling motion of the top roller to follow the bottom roller, thus ensuring that the bottom and top rollers will move in close and inseparable relation to each other. Thus, this follows the principle of the pendulum system in that in the case where one end is supported in a pivot fashion in the guide arm, the top roller held by the holding part at the other end is free with respect to the three axes in the coordinates in space, namely, in the X, Y and Z axis directions, so that the top roller held by the guide arm is pressed against the bottom roller in complex relation of point, line and surface contact in a manner which allows the yawing, rolling and pitching motions thereof.

In this case, the main factor in maintaining the parallelism of the top roller with respect to the bottom roller is the yawing motion of the top roller. If the yawing motion of the top roller perfectly follows the bottom roller, all the conditions are balanced and the maintenance of the parallelism of their axes is established, so that a stable, surface contact nip can be obtained. On the contrary, if it is not able to follow the bottom roller, all the other conditions lose their balance, making it impossible to achieve the intended object.

If, therefore, a method is employed in which with the rotative axis of the top roller held parallel with a reference axis based on the rotative axis of the bottom roller, only the yawing motion of the guide arm is strictly controlled while allowing it to freely follow in the other directions, namely, with respect to the motions, pitching and rolling, then it follows that the various conditions needed for the top roller weighting condition are satisfied, as described above. So long as this condition is maintained, the condition of the nip for fleece having a given width becomes satisfactory and stable for any heavy load. This relation perfectly holds for the pitching motion, but for the rolling motion, theoretically it slightly influences the yawing motion. However, its displacement is practically negligible with respect to a very small displacement of the order of bottom-roller deflection and hardly becomes such a displacement as will have a sufficient influence on the yawing motion to upset the parallelism.

The reason therefor is shown in FIG. 10. Supposing a spherical surface eccentricity adjuster to have a radius R (the amount of deviation $\delta$), the amount of displacement $\beta$ in the yawing direction with respect to the angle $\theta$ of the rolling motion at the point of contact between the spherical surface and the guide arm is expressed as follows.

$$\beta = R\,(1-\cos\theta)$$

It is seen that $\beta$ is nearly equal to zero for an infinitesimal displacement of $\theta$.

In the adjustment system, various methods may be contemplated and in this connection FIGS. 8 and 9 show an example of the eccentric type and FIGS. 11A and 11B and 12 show examples of the adjusting pin type. FIGS. 11A and 11B shows the adjustment type using a lock nut no, while FIGS. 12A and 12B show the clamp type using a plate spring n1 or n1', C shows the type using crimping n3, D shows the type using an elastic body n2 such as rubber, and E shows the use of a tube n4 of a relatively soft metal such as lead or copper combined with means for deforming the same to fix an adjusting pin m at the middle. F shows a way the adjusting pin is fixed by using an adhesive agent or solder n5. Each type has been developed so that it allows adjustment when necessary. Thus, a suitable jig is prepared for each type and is used when necessary to make adjustments, thereby eliminating troubles due to the deviation of the top roller. However, this system requires skill and time in making adjustments, so that it is difficult to put into practice. Therefore, it is used by makers as when a statistical method is applied to a weighting arm assembling operation to correct errors.

At any rate, these systems are based on a concept which almost ignores the self-aligning function of the pendulum arm, denying natural laws, which could be advantageously utilized, and in practice there is something unreasonable, as described above. Thus, they cannot be called carefully thought-out measures. However, sufficient merits can be obtained by applying them to a wide gauge top roller or very slowly rotating top rollers including the second top roller and the following which are heavily loaded and whose rpm is very low. Further, there has been an example in which a control system similar thereto is applied in the form of a guide arm control clip to the weighting arm in the flyer frame. But this is nothing more than a makeshift means somewhat different in category from the above described adjustment pip system. At any rate, judging from the weighting arm arrangement now in use, this type of adjustment systems provide an effective measure as considered from the manufacturing errors in the current mass-production system. Further, a system based on the fixed type concept premising that the arm body is set always correctly as designed as in the saddle system produced by some leading firms is far from satisfactory as evidenced by many actual examples thereof and by the actual results of maintenance thereof for years, and the fact that under the present circumstances it forms a cause of complaints from the standpoint of quality should not be allowed to pass unnoticed.

As is evident from the above, so along as the weighting arm of the conventional system is resorted to, it is a task of extreme difficulty to maintain or control the parallelism of a vast number of top rollers which are operating in textile mills. However, judging from the fact that the parallelism of the top roller R contributes much to improving the quality, production efficiency and operational stability in the various subsequent processes, it should be of vital importance to create a new technical arrangement which is capable of making effective use of the self-aligning performance.

The description given so far has clarified the present condition concerning the circumstances and drawbacks of the weighting arm in the weighting arm unit now in use. The actual condition especially of the pendulum type arm which, though based on an ingenious idea, has its self-aligning performance not fully developed because of its structural drawbacks, has been described by citing concrete examples. Now, the principle of the self-aligning performance of the pendulum arm will be considered by going back to its starting point.

FIGS. 13A and 13B are views explanatory of the self-aligning action. FIGS. 13A and 13B illustrate the basic principle of the pendulum arm system is shown in FIGS. 13A and 13B. When a driving surface D' is continuously moving in the direction of arrow YY', the press arm A is supported by a small-diameter pin I at fulcrum O in a pivot fashion, orthogonally holds the rotary shaft XX' of the driven roller R and is pressed substantially perpendicularly at a fixed point P on the guide arm by press means. In this arrangement, the press arm A continues to strictly maintain the relation of jojo'⊥XoXo' under the condition of YY'⊥XX'. This phenomenon is preserved irrespective of the number of rollers seen in FIG. 13, A and B, and remains unchanged so long as there is no disturbance from the outside.

The main points of a dynamic consideation of the reason therefor will now be described with reference to FIG. 14. With the driving surface D' continuously moving in the direction of arrow (parallel with the YY' axis), consideration will be given to three basic postures a, b and c of the driven body R with respect to its holding axis xx'. For the movement of the driving surface D in the direction of arrow parallel with the travel direction datum axis YY', the posture a of the driven roller R shows condition in which it is at its datum axis original position where the relation YY'⊥xoxo' || XX' holds; the posture b shows a condition in which the roller is rightwardly upwardly inclined at an angle $\theta$ with the reference axis XoXo', and the posture c shows a condition in which it is leftwardly upwardly inclined at an angle $\theta$ with the datum axis XoXo'. Therefore, in the posture a, the midpoint Q on the roller R is positioned always on the datum axis YY' extending through the pivot-like support point O and no angular displacement thereof takes place on the driving surface D'. On the other hand, the path described by the midpoint Q2 on the roller R2 is as shown by a straight line yly'l' while that for the roller R1 in c is represented by a straight line YrYr'. Since the roller R makes line or surface contact with the driving s surface widthwise of the roller, it describes paths on the Jo, Jl and Jr surfaces, respectively. That is, in b and c, as shown in FIG. 14, these paths are defined by an angle of inclination $\theta$ of the driven roller R with the datum axis YY', and in the positional relation shown in FIG. 14, both a and b follow paths approaching the datum axis YY'. The speed s thereof expressed as follows.

$$s = V \sin\theta \qquad (1)$$

Dynamically, this relation can be directly replaced by a vector value having the direction of force F.

As shown in FIGS. 15A and 15B suppose a weighting arm construction wherein a support arm OQ having a length l and occupying a fulcrum O on the datum axis YY' holds the roller shaft xx'.

So long as the normal datum positonal relation XX' || XoXo⊥YY' is retained and the driving surface D' travels in the direction YY', the normal position is maintained for ever since there is produced no vector in the direction which displaces the axial direction XoXo'.

In FIGS. 15A and 15B when a case where the driving roller R is in the conditions of R1 and R2, it is seen that in the condition of R1, a component vector T1 corresponding to the drive vector V is produced in the direction of axis x1x1' of the roller R1. As a result of this thrust, a torque M in the restoration direction equal to T1 l with the center at the fulcrum O of the swing arm is produced to bring back the weighting arm in the direction conforming to the datum axis YY' since the roll R1 is orthogonally supported by the swing arm of length l.

$$M = T1\,l \tag{2}$$

At this time, the vector corresponding to the component force in the rotative axis direction x1x1' of the driven roller R1, i.e. the thrust T1 produced in R1 is expressed as follows.

$$T1 = V \sin\theta \tag{3}$$

Thus, it becomes evident that the thrust is a function of the angle of inclination $\theta$ formed with the datum axis direction xoxo' of the driven roller R1.

From the equations (2) and (3), $$M = l\,V \sin\theta \tag{4}$$

From this equation it is seen that unless the angle of inclination between the rotative axis direction xx' of the driven roller R and the datum axis direction XoXo' of the driven body with respect to the tavel axis YY' of the driving body D' is stabilized such that $\theta=0$, the restoration torque M will not disappear. Thus, if $\theta=0$, then M=0 and the swing arm is stabilized at that position. In the case where the driven roller takes the disposition of R2, $\theta$ only takes a minus sign and the various relations remain unchanged.

What the theory described above is applied to is no other than the pendulum arm type weighting arm.

Therefore, in this form, the swing support part O forming a fulcrum for the pendulum action of a conventional weighting arm is in the form of a characteristic pivot-like support system and at the other end it correctly orthogonally holds the driven roller R. Further, the means for pressing the weighting arm usually comprises a spring, e.g. a compression spring (coil spring or volute spring) or a plate spring of special shape. The system shown in FIG. 1 is a typical example of this. In rare cases, said means comprises a pressing device using gas or liquid pressure, such as pneumatic or hydraulic pressure. Whichever system may be utilized, the present condition is that it is arranged to act on the upper surface of the weighting arm or on a spring receiving part integral therewith.

So long as a system corresponding or similar to this kind of arrangement is employed, it is certain that similar drawbacks exist therein. Particularly in the typical example shown in FIG. 1 using a spring, it can hardly be expected that a pressure vector or pressure distribution in the pressure contact region produced by the compression of the spring will be the theoretical, normal uniform distribution in the datum normal position of the weighting arm.

As described above, the existing pressing system, whether a compression spring (coil spring or volute spring) or plate spring, actually have individually considerably scattering intrinsic deviativities, and the direction of the spring pressure tends to scatter in a wide range also with respect to the axial direction of the spring. Thus, a technique for directing the direction of such spring correctly to the direction of the spring axis has not been established. Moreover, the tendency toward increasing the pressure in the weighting arm unit in accordance with advances in textile technology including the rise of synthetic fiber blend spinning in addition to the increase of draft ratio and of productivity on the basis of operating stability and the quality-first precept, has resulted in increasing the drawbacks of the existing weighting arm units.

Even if these deviativities produced in spring pressure, etc. remain in a very small range, the secondary, balance-destroying action influenced by the buckling phenomenon found in a compression spring and by the deviation of the axis of the pressing spring accompanying the angular displacement of the weighting arm A caused by said deviativities continues to interfere with the function peculiar to the pendulum arm of adjusting the axis of the driven roller R to make it parallel with the rotative axis on the driving side. This phenomenon may be considered to be shown in FIGS. 5 and 6 in terms of measured values. FIGS. 16A, 16B, and 16C explain this interfering phenomenon. Thus, as shown in a front view in FIG. 16A, the pressing construction of a conventional weighting arm is such that a compression coil spring 23 is supported at its upper end surface by a spring position controlling projection 25 on the ceiling of a guide arm case 21 while its lower end surface is supported under pressure by a spring position controlling projection 26 provided on the outer ceiling surface of a weighting arm 22. Driven rollers 24, 24' orthogonally supported at its middle by the weighting arm 22 are opposed to a driving body D in the illustrated relation. Therefore, the horizontalness of the pressure contact surface of the pressing spring 23 positioned on the outer ceiling surface of the weighting arm is governed by the manner of contact between the driving surface D and the driven rollers 24, 24'. The weighting arm construction is subjected directly to various influences from factors including the horizontalness of the pressing surface of the pressing 23 and the intrinsic deviativity of the pressing spring 23 during operation of the weighting arm 22 and the angle of deviation $\theta s$ of the center axis of the compression spring 23 due to the displacement of the pressing center P of the guide arm 22 with respect to the longitudinal datum axis ZZ' extending through the weighting point P of the weighting arm construction, with the result that an overall vector P1 acts on the weighting arm.

The overall vector P1 has an angle of deviation $\Delta\theta s$ with respect to the datum vertical axis ZZ' of the weighting arm construction. From this relation, the driven rollers 24, 24' have a thrust E produced in the direction of their rotative axis xx' which is a component thrust in the anti-restoration direction of the guide arm.

The size of the thrust E, as seen in a vector diagram shown in FIG. 16, B, is expressed as follows.

$$E = P1 \sin \Delta\theta s \tag{5}$$

Therefore, the deviation torque Ns which is a moment in the deviation direction acting on the point P of the guide arm 22 and produced by a pressure acting on the guide arm 22 is expressed by the following equation.

$$Ms = s\,P \sin \Delta\theta s \quad (6)$$

On the other hand, as shown in a plan view in FIG. 16C, the guide arm 22, under the influence of the deviating action, is positioned displaced by $\delta\theta$ relative to the datum axis YY' in the weighting arm construction extending through the center of swing motion O of the arm 22. Thus, from the equation (4) the restoration torque Mr produced at the center point Q of the driven rollers 24, 24' is expressed by the following equation.

$$Mr = 2l\,Vo \sin \delta\theta \quad (7)$$

The two kinds of moments, namely, the deviation torque Ms and restoration torque Mr having different directions described above simultaneously act on the weighting arm OQ1 at points P and Q. Therefore, the guide arm OQ continues to remain at a position where the two torques are balanced.

$$Ms = Mr \quad (8)$$

As shown in a plan view in FIG. 16C, with the weighting arm constructed to have rotatable rolls on opposite sides of the holding shaft of the guide arm, equal thrusts T1 and T2 are produced on opposite sides. Therefore, the equation (8) is developed as follows.

$$2V \sin \delta\theta = S\,P1 \sin \Delta\theta s \sin \delta\theta = (s/2l)(P1/V), \sin s\,\theta = \tfrac{1}{2} \sin^{-1}((S\,P1/1\,V) \sin \Delta\theta s) \quad (9)$$

It is evident from the equation (9) that it is the necessary and sufficient condition for $\theta=0$ that $\Delta\theta s=0$. That is, unless the pressing vector line coincides with the weighting datum axis ZZ' in the front view in FIG. 16, A, it will not return to the origin Q. The condition $\Delta\theta s=0$ theoretically is at the weighting arm original position where XX' || xx' || YY', and this condition is no more than the absolute parallelism of the rotative axis xx' of the driven rollers with respect to the right-angle axis XX' of the bottom driving surface D. This proves the fact that the self-aligning property of the top rollers with respect to the driving roller D of the pendulum type weighting arm is very imperfect. In order to achieve higher aligning performance heretofore demanded at job sites, i.e. the allowable deviation range within 0.3 mm indicated in FIGS. 5 and 6, it is required in an aspect of basic design to minimize or eliminate the pressing deviation characteristics of the individual pressing bodies or pressing assemblies. However, it is evident also from investigated data that it is impossible even by the existing technique to include the limit of management of tens of thousands or hundreds of thousands of lots in the above range. In this connection, FIGS. 5 and 6 prove that even the typical weighting arm which is produced with the highest level of technique and according to the best principle has been still insufficient to improve quality and operation in practice. Weighting arms used especially in textile mills are the key to form a roller nip which governs the quality of spun yarn and operating efficiency. Therefore, it is an important subject to improve the parallelism of the driven rollers R with respect to the driving bottom roller D in that case.

SUMMARY OF THE INVENTION

The present invention has been developed in view of the above subject and relates to a construction wherein on the assumption that the pressing deviation characteristics peculiar to a pressing body or assembly which are the main cause of troubles are allowed to exist at substantially the present level, a rolling-contact bearing element or rolling assembly is interposed between it and a guide arm to isolate them from each other, the function of the rolling element being utilized to eliminate the deviation vector while transmitting only the necessary pressing vector directed in the direction of the vertical datum axis ZZ', thereby making fullest use of the self-aligning principle and function of the known pendulum arm system.

FEATURES OF THE INVENTION

Weighting arm assemblies according to the present invention may be arranged in a plurality of rows inside the weighting arm body, whereby they can serve as a weighting arm device capable of performing the necessary and sufficient weighting arm function for the respective lines in the draft section. Therefore, the invention has high rationality in that it has versatility to provide for production of many kinds of types or standards as well as the capability of unifying standards to provide for mass-production. Particularly the significance of its capability of opening the way for high rationalization of manufacturing facilities is evaluated more highly than expected.

As for the effects of the invention on the performance of the weighting arm used in a spinning frame, the great improvement of the parallelism of the axes of the bottom and top rollers D and R is almost unfathomable as a merit of improving the quality of yarn material. The improvement of the quality of yarn material not only contributes to the improvement of the quality of textile end products but also increases operating efficiency and productivity in spinning process and at the same time minimizes the occurrence of defects in yarn and has great effects on the production facility efficiency and productivity in the secondary process and those that follow. For example, when a yarn material providing about 0.5–15 increase in $\Delta\theta s$ of $40^s$ combed yarn is used, there is an example showing an expectedly high improvement percentage in the process for preparing for weaving and in the weaving process, as shown in FIG. 25. This is why the requirements for quality of material for yarn are becoming increasingly severe in proportion to advances in the processing facilities in the subsequent processes and the diversification of products. These conditions can hardly be satisfied with the present level of the parallelism found in the existing weighting arms. (See FIGS. 5 and 6.) Thus, there is no end to the requirements for the weighting arms in the spinning frame. That is, the problems including first the increase of pressure, second the stabilization of quality, third the convenience of operation and fourth freedom from maintenance are all difficult to solve. When the most modern weighting arm unit, if frankly criticized from the standpoint of an expert, has many problems including those described above which must be solved. That is, whereas great merits are provided by the weighting arm unit, the important aspect of stability is sacrificed to convenience.

Among other things, it is pointed out that it is in the parallelism of the top roller that the greatest drawback is exposed. Needless to say, the parallelism of the top roller directly governs the performance of the draft section, forming a main factor affecting the quality of yarn. The improvement thereof will result in raising the level of textile technology. In brief, the present invention is arranged to enable all the top rollers associated with the spindles in a spinning frame to be confined within the allowable range of deviation of the parallelism of top rollers (where no yarn unevenness takes place). Thus, the invention is significant.

In addition, the invention provides a self-aligning type weighting arm construction which is usable not only with textile machines but also with other similar machines using a parallel-hold type rotatable press roll assembly.

BRIEF DESCRIPTION OF THE DRAWINGS

FIGS. 1–16c of the drawings present herein illustrate various prior types of weighting arms employed heretofore with such figures being identified as follows:

FIG. 1 is a side view of a conventional adjusting type guide arm that has been employed heretofore.

FIG. 2 is a plan view of the arm shown in FIG. 1.

FIG. 3 is a graph showing deviated conditions according to a self-aligning device utilizing the guide arm shown in FIGS. 1 and 2.

FIG. 5 is a graph showing the frequency distribution of parallelism of back top rollers in conventional prior art devices.

FIG. 6 is a graph showing the frequency distribution of parallelism of front top rollers.

FIGS. 8, 9, and 10 illustrate a further conventional adjustable type guide arm employed heretofore.

FIGS. 13A and 13B are views illustrating the self-aligning action of previously employed arms.

FIG. 14 is a view illustrating the main point of dynamical consideration of the self-aligning action.

FIGS. 15A and 15B are imaginary views of a conventional weighting arm assembly employed heretofore.

FIGS. 16A, 16B, and 16C are views illustrating difficulties that may be encountered with prior art device.

The illustrative embodiments of a weighting arm assembly formulating the present invention are shown in the following figures, wherein:

FIGS. 17A and 17B thereof are a front elevation and an end elevation respectively of a weighting arm embodiment made in accordance with the present invention.

FIGS. 18A and 18B are corresponding views of the embodiment shown in FIGS. 17A and 17B with the pressing spring removed, with FIG. 18B being an enlarged fragmentary view.

Figure 1:
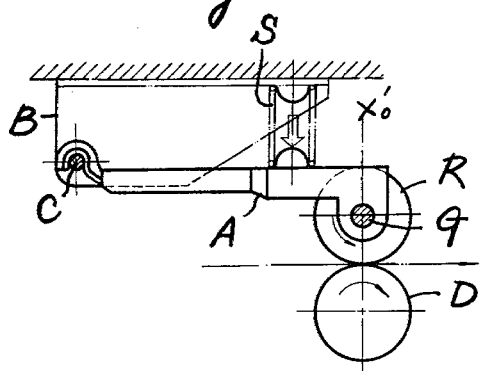
Fig 1 PRIOR ART
Figure 2:
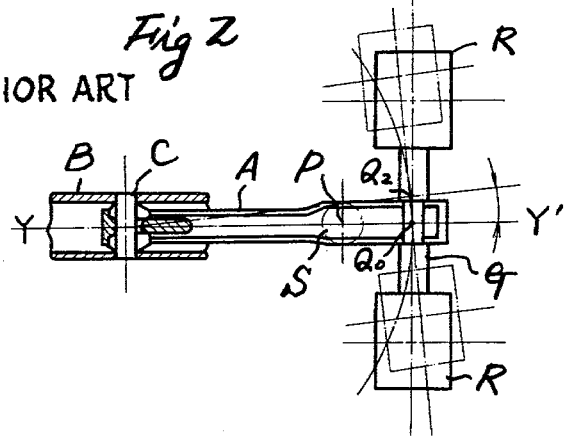
Fig 2 PRIOR ART
Figure 4A:
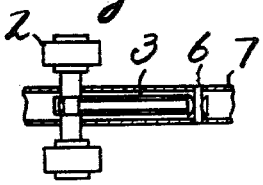
Fig 4A PRIOR ART
FIGS. 4A and 4B thereof illustrate a conventional pendulum type guide arm.
Figure 4B:
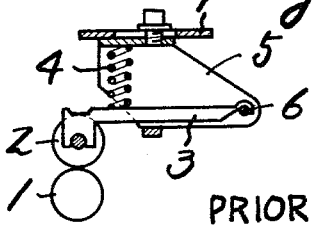
Figure 3:
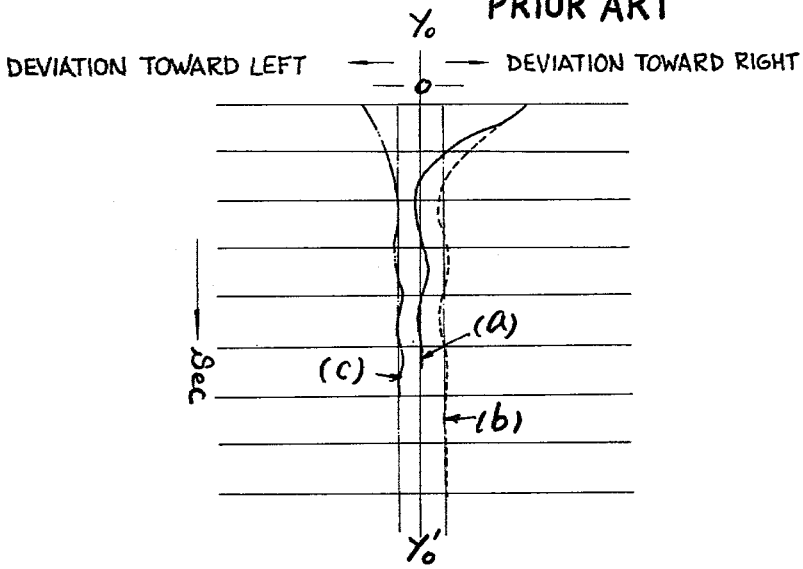
Fig 3 PRIOR ART
Figure 5:
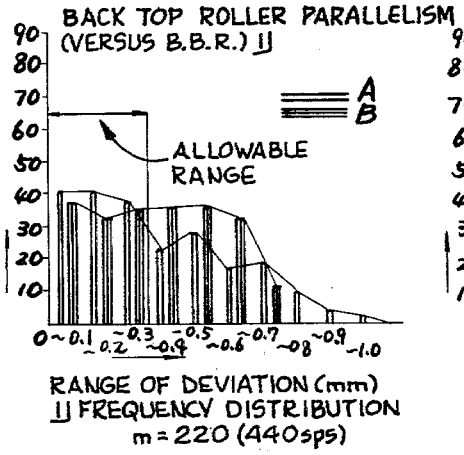
Fig 5 PRIOR ART
Figure 6:
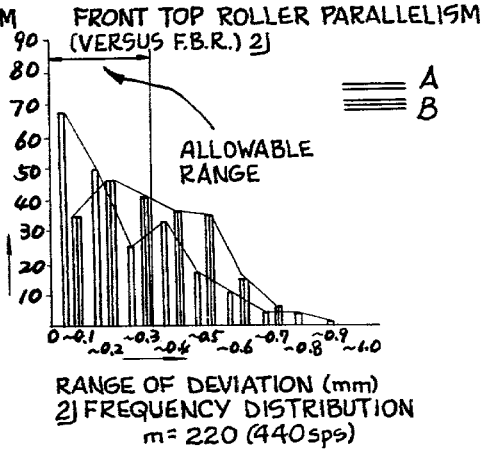
Fig 6 PRIOR ART
Figures 7A, 7B, 11A, 11B, 12A, 12B, 12C, 12D, 12E, 12F:
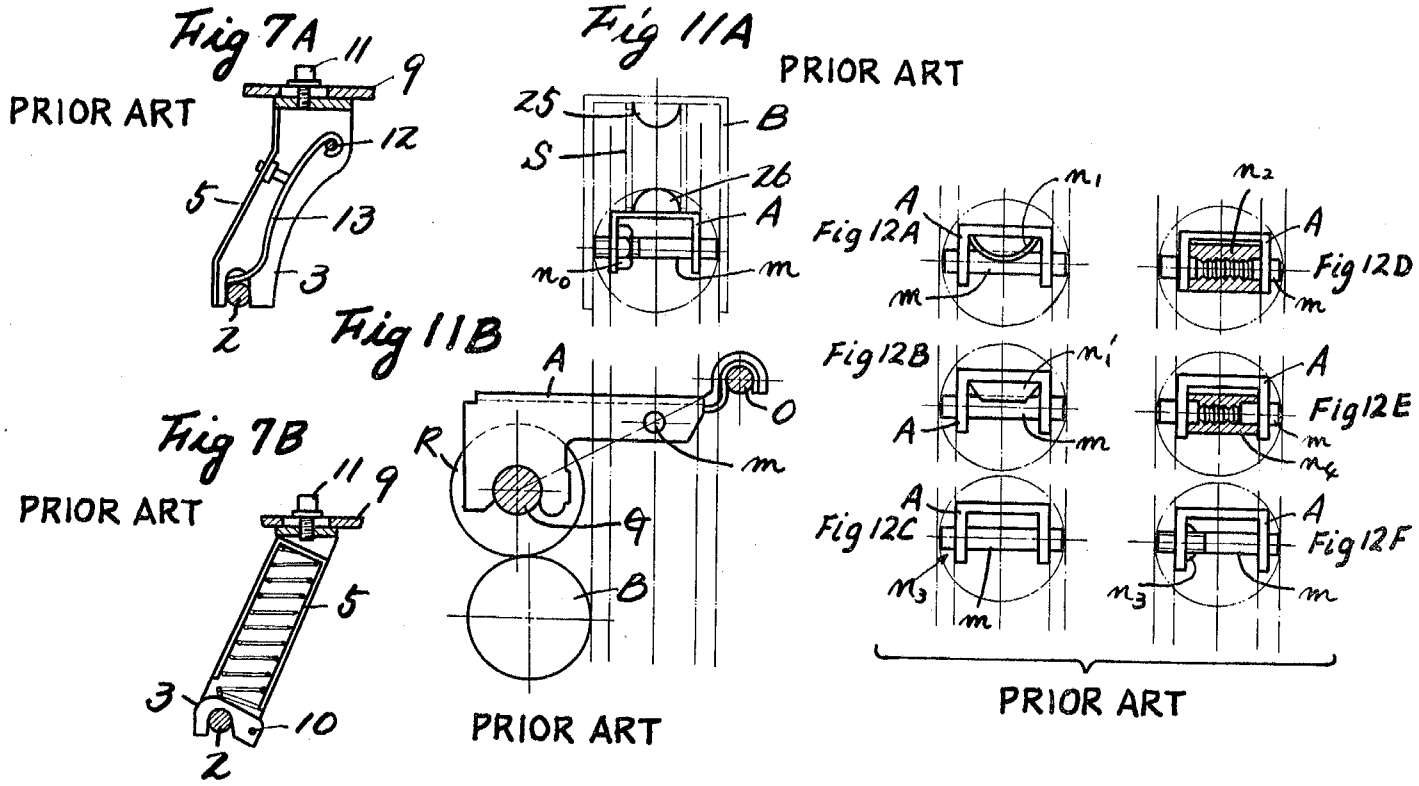
Fig 11A PRIOR ART
Fig 11B PRIOR ART
Fig 7A PRIOR ART
Fig 7B PRIOR ART
Fig 12F PRIOR ART
FIGS. 7A and 7B illustrate a conventional fixed type guide arm employed heretofore.
FIGS. 11A,B and 12A-F illustrate specific examples of adjustable types of arms that have been employed heretofore.
Figures 15A, 15B, 16A, 16B, 16C:
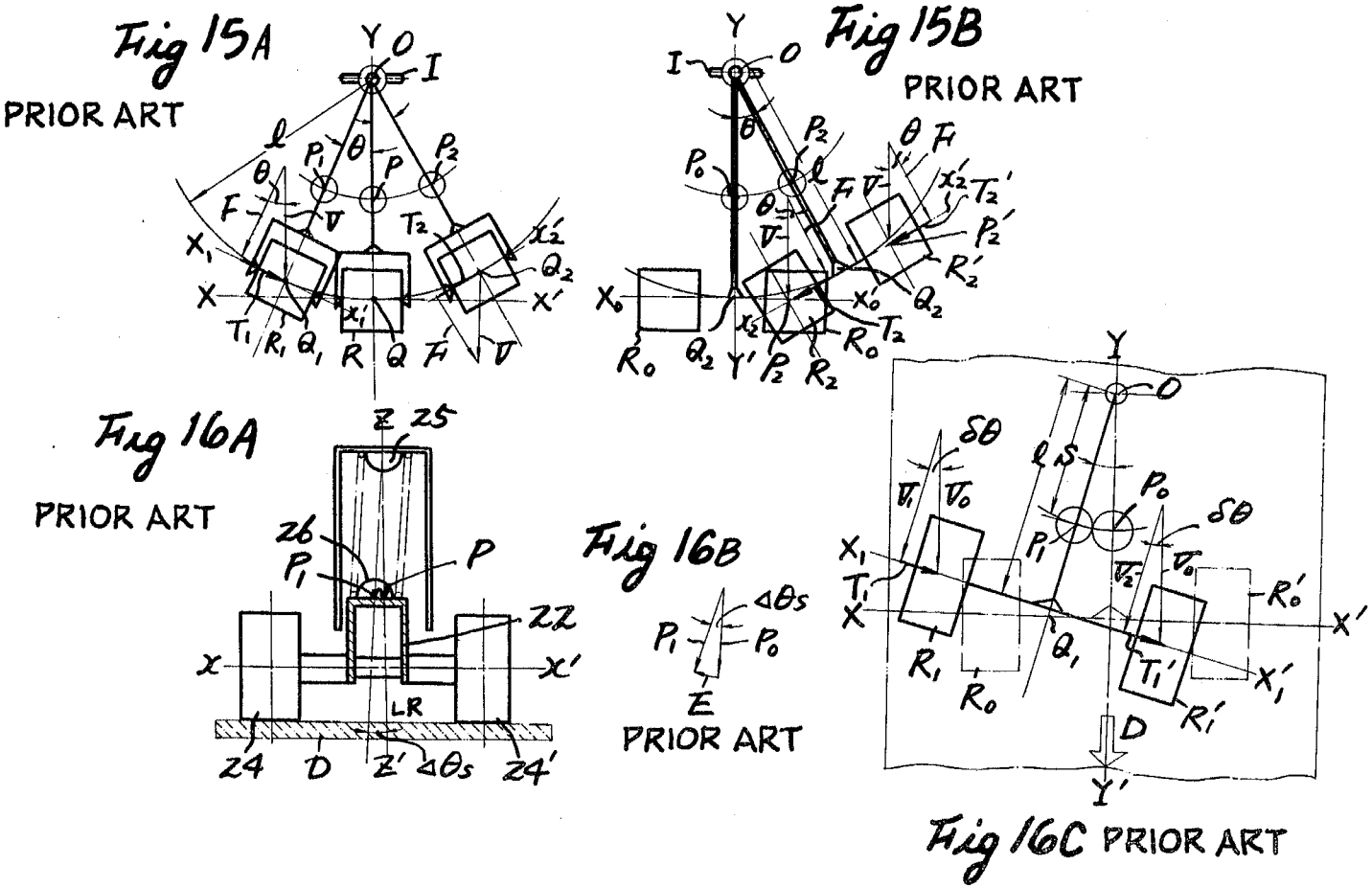
Fig 15A PRIOR ART
Fig 15B PRIOR ART
Fig 16A PRIOR ART
Fig 16B PRIOR ART
Fig 16C PRIOR ART
Figures 19A, 19B, 19C, 19D, 19E, 19F:
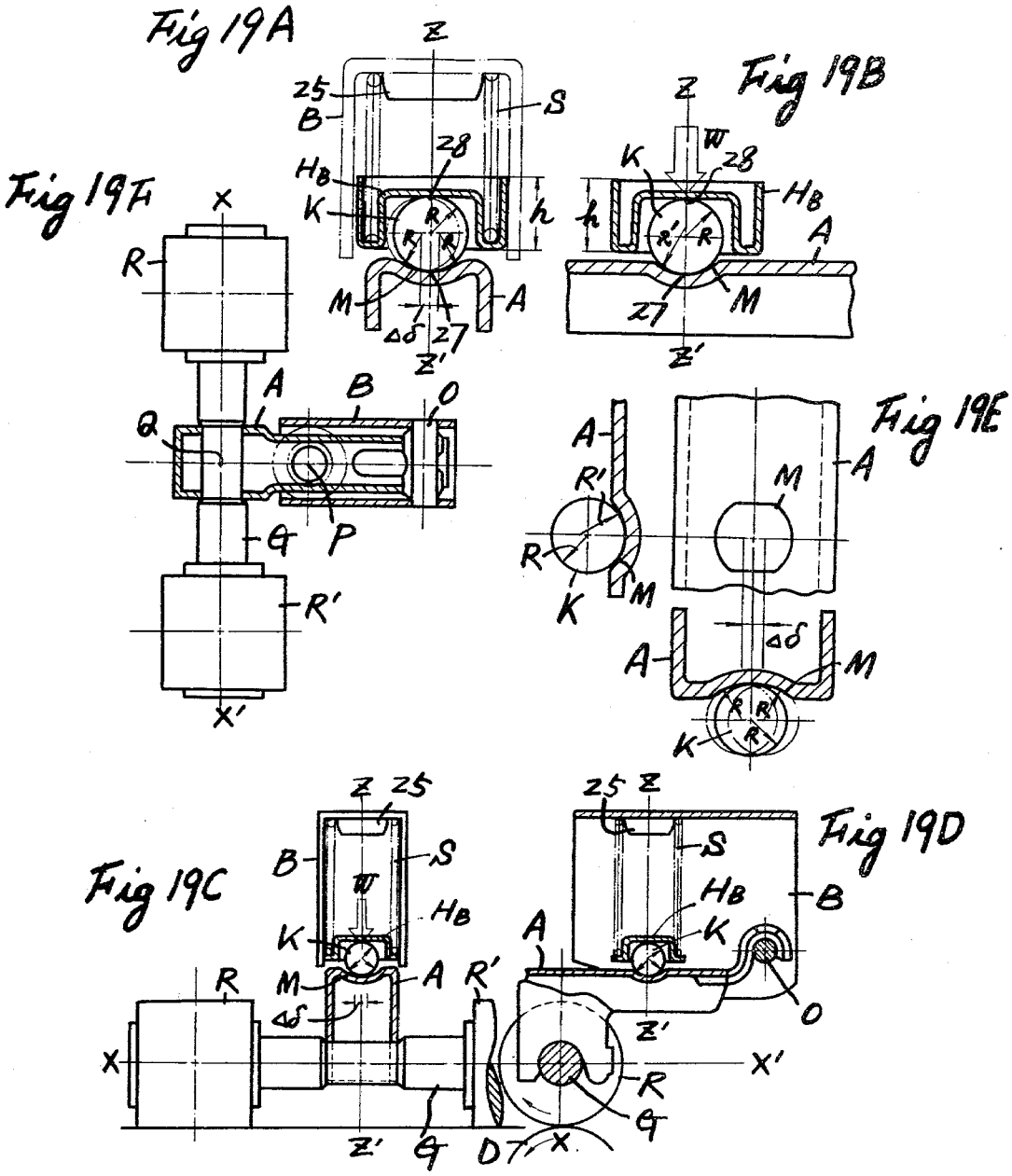

FIGS. 19A and 19B are fragmentary front view of the weighting arm made in accordance with the present invention and a side view of a weighting arm device made in accordance with the present invention, respectively.

FIGS. 19C, 19D, and 19E and 19F are other views illustrating a weighting arm device of the type shown in FIGS. 19A and 19B.

Figure 20A:
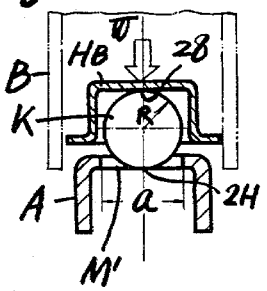
Figure 20B:
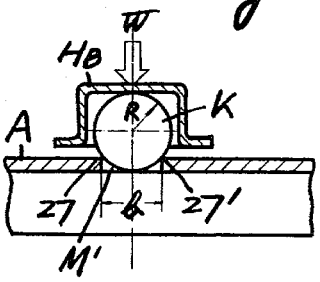

FIGS. 20A and 20B are front view and a side view respectively of another embodiment made in accordance with the present invention.

Figure 21A:
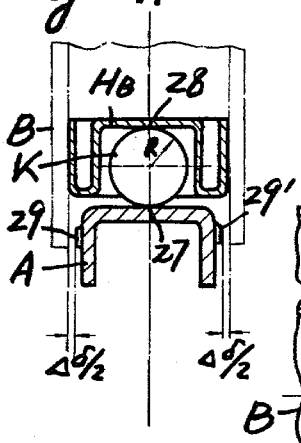
Figure 21B:
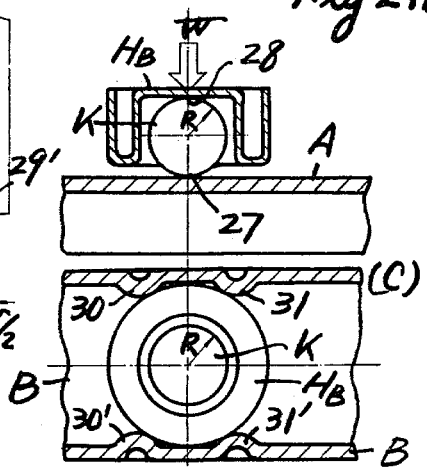

FIGS. 21A, 21B, and 21C are a front view, a side view, and an end view respectively of another embodiment made in accordance with the present invention.

Figure 22A:
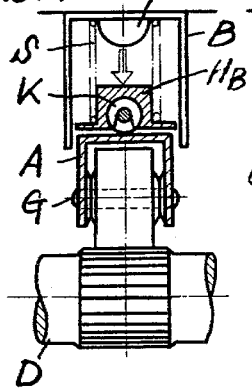
Figure 22D:
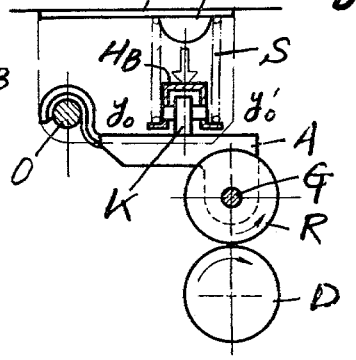
Figure 22B:
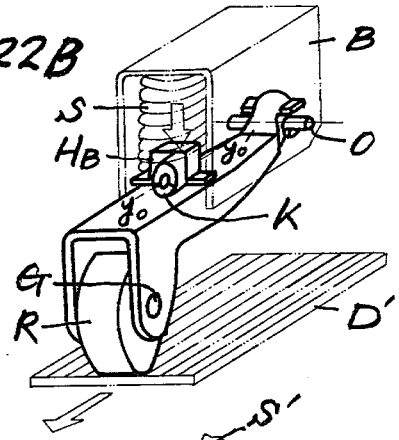
Figure 22C:
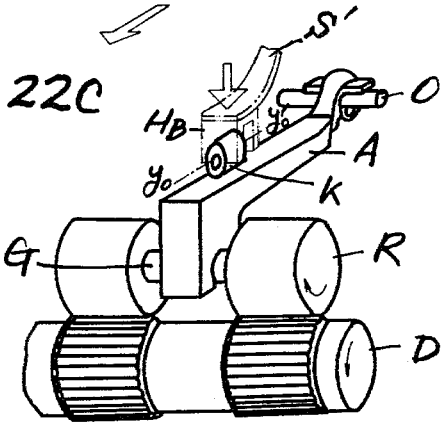

FIGS. 22A, 22B, and 22C are a front view, a pair of perspective views and a side view, of still another embodiment made in accordance with the present invention.

FIGS. 23A and 23B are enlarged fragmentary views of the form of the invention shown in FIGS. 22A–22D, but with a different mode of assembly of the roller shaft.

FIG. 24 is an enlarged fragmentary cross-sectional view of a universal type weighting arm construction made in accordance with the present invention for use in the draft section of a textile machine.

FIG. 25 is a table showing improvement percentages under various items.

DESCRIPTION OF THE PREFERRED EMBODIMENTS

In the ensuing description like reference letters and numerals employed in FIGS. 1–16 which illustrate the prior art will be employed for like parts in FIGS. 17A–25 which illustrate embodiments made in accordance with the present invention. More particularly, in FIGS. 17A–25, reference letter A designates a guide or weighting arm, reference letter B designates a guide arm case, reference letter C designates a guide arm pin, reference letter D designates a driving body which may be a curved surface or a plane surface, reference letter R designates driven rollers actuated by the driving body D, and reference letter G designates a driven roller shaft. The operation of these like parts will be the same as disclosed in FIGS. 1–16C.

FIGS. 17A and 17B and 18A and 18B show embodiments incorporating the basic nature of the present invention, and the structural concept thereof will now be described.

(1) The construction of a support point O for swing motion of a guide arm of weighting arm A in the rear is by the pivot-wise support method.

(2) A rolling element is received in the lower end surface of a pressing spring S'. There is provided a bottom cap HB of the illustrated shape. For example, in the case of a compression coil spring, a cap having a cross-sectional shape like the figure is provided and this cap HB receives a rolling element, for example, a ball K or a cylindrical roller or a shaft-equipped roller. The ceiling inner surface X3X3' of the bottom cap is arranged so that with respect to the upper surface X5X5' of the guide arm case it is maintained in the relation X3X3' X5X5' during operation.

(3) At a predetermined position on the upper surface of the guide arm opposed to a pressing body or pressing assembly, a rolling-purpose flat surface portion X2X2' is formed to provide a small guide surface.

(4) Even if (2) and (3) are reversely installed, the resulting arrangement will be the same in general function, with some exceptions.

(5) The pressing spring S' is usually in the form of a compression coil spring. The 90-degree angularity of the opposite end surfaces of the spring S' with respect to its longitudinal axis, and the parallelism of said opposite end surfaces are strictly controlled according to JIS (Japanese Industrial Standard). Although some scatter is produced, if it is within the range specified by JIS experiments have proved that such scatter does not matter. In installing the spring S', its upper surface is vertically fitted on a projection 25 formed at a predetermined position on the ceiling of the guide arm case. The ceiling inner surface X3X3' of the bottom cap HB mounted on the lower surface of the pressing spring S' in this condition could somehow retain a nearly horizontal condition but this can hardly be said sufficient. In the present invention, therefore, the bottom cap HB is combined with the pressing spring S' in such a manner that the fit clearance with respect to the diameter of said spring (whether the inner or outer diameter) is minimized and at the same time it is combined with the guide arm case B (in some cases, the arm body) in such a manner that the fit clearance between the diameter (or width) d of the bottom cap HB and the widthwise inside dimension w of the guide arm case is similarly minimized. As a result of this design, the vertical axis of the pressing spring S' approximately coincides with the datum axis ZZ' of the width of the case. Thus, this arrangement assures that the pressing spring S will be maintained upright at the predetermined position on the ceiling surface X5X5' of the guide arm case B, while minimizing the causes of deviation such as buckling phenomenon, so that the axis of the spring substantially coincides with the central axis of the width of the guide arm case B and hence the pressure exerted by the spring acts vertically. In response thereto, the ceiling surface X3X3' of the bottom cap HB maintains the posture X5X5' || X3X3' so that through the pressing structure using the ball or other rolling element K contained in the bottom cap HB, the pressure of the spring S' is transmitted to the ceiling surface X2X2' of the guide arm B in the correct direction, that is, only the required correct pressure obtained by eliminating the intrinsic deviativity of the pressing spring S' is transmitted.

(6) On the other hand, the self-aligning function of the driven roller R provided by the driving of the driving body D acts in accordance with the principle described above, producing the self-aligning swing motion of the weighting arm A around the fulcrum O. As a result, the resistance to the rolling of the rolling elenent K at points of contact 27, 28 between the ceiling surface X2X2' and the ceiling surface X3X3' of the bottom cap HB is minimized almost to zero. Thus, an ideal pendulum type weighting arm construction allowing the guide arm A to swing independently of the pressure and without any substantial resistance can be obtained. As for the parallelism of the upper and lower races XX' and X2X2' between which the rolling element is interposed, some amount of tilt relative to each other away from parallelism cannot be avoided in practice. However, in the present system incorporating compensating means as described above, the relative tilt remains within a very small range and no slipage on the races occurs since the pressure being transmitted acts to increase the resistance. In brief, the most characteristic feature of the present invention consists in the fact that the arrangement comprising a rolling element interposed between the bottom surface X3X3' of the pressing body and the upper surface X2X2' of the weighting arm on the pressed side provides three different functions, namely, the rolling function, the pressure transmitting function and the function of eliminating the deviative pressure vector component of the pressing body between the races defined by the upper and lower parallel surfaces between which the rolling element is held. That is, the invention has opened a new way for maintaining the resistance to the self-aligning swing motion of the weighting arm always at zero even under high pressure and fully developing the pendulum performance. As a result, a rolling support type pressing construction is formed which responds to the restoration torque automatically produced on the weighting arm side with very high sensitivity even under heavy load, whereby the pure pressure which does not interfere with the pendulum function of the weighting arm A is accurately transmitted to the top roller R.

(7) In the draft section of the textile machine, the angle of swing of excessively large amplitude found in the existing pendulum arm is unnecessary and moreover, in most cases, superfluous swing is harmful. Particularly in the large-size heavy-load weighting arm demanded in recent years, the excessiveness of the angle of swing has close correlation with the degradation of the parallelism of the top roller R.

The present invention has investigated the principle of the self-aligning function of the pendulum system heretofore sought after by the weighting arm as an ideal and has opened a new way for most reasonably making efficient use of it. Further, the invention has investigated the causes of the degradation of the parallelism found in the conventional systems and has one of the features consisting in the fact that in order to increase stability necessary for advantageously using the intrinsic features of the conventional systems, a particular limited range is set for the angle of swing of the weighting arm A and the limit value of the effective amplitude thereof is associated with the range of cumulative error produced during manufacture of weighting arms so as to limit the amplitude to an allowable minimum by special means. Thus, the invention was successfully provided a construction having a perfect self-restoration function by applying a unique idea based on the above described various concepts and experiments to make reasonable use of the principle of the self-alignment of the pendulum system.

As is evident from the above, in the present invention, the long experience and information concerning the characteristics of the existing typical weighting arm have been systematically arranged to investigate and grasp the merits and demerits of said weighting arm. The conclusion is that the principle of the self-alignment of the known pendulum system is theoretically quite correct and, if correctly applied, will provide superior stable functions most suitable for the weighting arm. The reason why the parallelism of the top roller R is disturbed is that the defects of the weighting means for the weighting arm impede the performance of the top roller, as described above. Thus, the conclusion is that even if the pressing means or pressing device has its intrinsic directionality, the correct self-alinging function peculiar to the pendulum type arm can be derived if some measure is taken to eliminate the influence of said directionality. In the present invention, therefore, a method is employed which denies the self-alignment of the conventional weighting arm construction and incorporates a rolling element or device between the weighting arm A and the pressing body or pressing assembly S.

The arrangement of the invention will now be described in more detail with reference to FIGS. 19 through 24.

FIGS. 19A–21C show the relation between the bottom cap HB holding the rolling element K and the guide arm case B and also show various postures at points of contact 27, 28 between the rolling element K and the bottom cap HB and guide arm A.

FIG. 19A shows a front view of the weighting arm device and FIG. 19B shows a side view thereof. In FIG. 19A, a recess M is formed at a region of the guide arm A where the rolling body K is pressed thereagainst. The configuration of the recess is such that when viewed in the side view B, it is an arcuate groove having a radius R' somewhat greater than the radius R of the ball K and that when viewed in FIG. A it has a radius R equal to the radius R of the ball K with its center displaced by a distance $\Delta\delta$ so as to form a flat surface over the distance $\Delta\delta$. Since the ball K rolls within this recess M, the horizontal swing of the guide arm A is performed in the range of said flat surface $\Delta\delta$, thereby making it possible to control the swing angle of the weighting arm A. The portion of the ball K greater than its radius is received in the inside pocket of the bottom cap HB with some clearnace therebetween so that there is no interference with the rolling of the ball K. Further, in the side view B, the design of the cross-section of the groove M does not allow the horizontal displacement of the ball K, thus maintaining the contact point 27 on the datum axis ZZ'.

On the other hand, the bottom cap HB is fitted in the guide arm case B ith a minimum clearnace therebetween and, if necessary, it occupies a height h. As a result, there is obtained the function of compensating for the influence of the deviation tendency or buckling phenomenon peculiar to the pressing spring S.

Although the control of horizontal displacement of the bottom cap HB as viewed in FIG. 19B is omitted in this system, there will be no trouble in practice since the ball K is controlled by the race groove M in the guide arm A.

FIGS. 20A and 20B show a system in which the ceiling plate of the guide arm A is formed with a rectangular race groove M' for use as a race for the ball K. In this case, the amount of rolling displacement of the ball K is controlled by the dimension of the longer side a of the rectangle, as shown in FIG. 20A. Further, as seen in the side view 19B, since the race for the ball K has a groove width b, the ball K contacts the race at two edges 27 and 27', whereby the same operating condition as in FIG. A is established. In FIG. 19A, although the bottom cap HB is loosely fitted in the guide arm case B only by means of its plate thickness, this is sufficient if the accuracy of the pressing spring S is good.

FIGS. 21A and 21B show a system belonging to the most typical of the embodiments of the invention. As shown in the front view 21A, swing control projections 29, 29' are provided at particular positions on opposite outer surfaces of the guide arm A. This idea is similar to that of using the previously described control pin (see FIGS. 11A–12B) and there is left a swing clearance $\Delta\delta$ relative to the inside dimension of the guide arm case A. This relation corresponds to the plane distance $\Delta\delta$ shown in FIG. 19A. Instead, it becomes unnecessary to form a recess in the upper surface of the guide arm A. The other conditions are same as those of the system shown in FIGS. 19A–19E. However, a construction is added wherein guide projections 30, 30', 31, 31' disposed on opposite inner surfaces of the guide arm case B to surround the outer periphery of the bottom cap HB, as shown in the plan view C in FIGS. 21A and 21B, control the movement of the bottom cap HB so that it moves only in the correct spring pressing direction, i.e. in the direction of the pressing axis of the pressing spring without doing deviative actions in any other directions. This construction can be applied, without any change, to the embodiments shown in FIGS. 19A–20B. FIGS. 22A–22D show another embodiment concerning the rolling intermediary. As shown, this embodiment belongs to the type using a roller K' having a shaft.

FIG. 22A, shows a front view and 22B shows a side view. FIG. 22C is a perspective explanatory view. FIG. 22D shows a weighting arm construction using a roller K' having a shaft.

The system FIGS. 23A and 23B are the same as that shown in FIGS. 22A and 22D in that it uses a roller K', but the way the shaft of the roller is assembled is different. Thus, as contrasted with the system of FIGS. 22A–22D having the shaft attached to the bottom cap HB, the system FIGS. 23A and 23B has the shaft attached to the upper plate portion of the guide arm A. At any rate, the systems shown in FIGS. 22A–23B have the advantage that the rolling element K', or K which is an intermediary, can be stabilized by the setting of the shaft and hence the swing action of the guide arm A is further stabilized. However, in some cases, such construction tends to become complicated and, on the other hand, simplification involves some cause of slippage. Some amount of slippage does not so much matter and this system is convenient in cases where priority should be given to stabilization.

The embodiment shown in FIG. 24 is an example of the so-called universal type weighting arm construction applicable to the various lines (front roller, 2nd roller, 3rd roller, etc.) in the draft section of a textile machine.

In FIG. 24, the swing axis O for the weighting arm for supporting one end of the weighting arm A is located at the lower end of the guide arm case B. The other end of the weighting arm A is provided with a stay know 43 which is received on the lower edge of a rectangular opening 14 formed in the guide arm case. The arbor G of the top roller R is securely held at right angle by a central lower inverted U-shaped groove in the guide arm A. The opposite ends of a pressing coil spring S' are provided with a top cap 32 and a bottom cap 31 to form parallel surfaces at right angles with the central axis of the spring S' extending along said opposite end surfaces.

The upper surface of the guide arm is formed with a race for the ball K. Usually, in the race for the roller arrangement, the center of the roller K is located on the datum axis XX' of the weighting arm construction so that the roller will not displace forwardly or rearwardly of the guide arm A, while a particular limit range is provided in the direction of swing. Thus, the arrangement is similar to those shown in FIGS. 19A–21B. More than the upper half of the ball K is received in the bottom cap 31 and its top is in contact with the ceiling surface thereof under pressure.

The bottom cap 31 and top cap 32 are fitted in the inner diameter of the pressing spring S' with a minimum clearance therebetween and their outer surfaces are fitted likewise in the guide arm case B with a minimum clearance therebetween, so that they are slidable only in the pressing direction. The upper assembly 36 of the guide arm case B forms an attaching base part for selectively fixing the weighting arm assembly at a predetermined position on the weighting arm main body 42 and also serves as a base for adjusting a screw 35 which adjusts the pressure of the pressing spring S'.

As for the spring pressure adjustment, this embodiment shows a basic system using ascrew and gauge plate 41, but this is an example only, since many methods may be used, including one using a stepwise adjustable top-shaped cam and one using a comination of a lever device and a cam device. Therefore, the invention is not limited to the screw adjustment type. Further, pins 38, 38' illustrated are an example of means for uniting the upper and lower assemblies 36 and 37 of the guide arm case B. It is also possible to form them integral with the guide arm case B.

While there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

I claim:

1. In a pendulum arm type, self-aligning weighting arm assembly for use with textile machinery and having casing means, said casing means including a pivot member, weighting arm means pivotally mounted at one end to the said pivot means of said casing means for movement in a plurality of directions, rotatably driven roller means rotatably mounted on the opposite end of said weighting arm means, driving body means operatively positioned with said driven roller means for rotating same and pressing means operatively engaged with said weighting arm means intermediate the ends thereof urging said driven roller means into engagement with said driving means, the improvement of the pressing means which comprises cap means U-shaped in cross-section positioned in the lower end of said casing means for vertical movement therein, a rolling contact bearing element positioned within said casing means and between the bottom of said cap means and the top surface of the weighting arm means intermediate its ends thereof and in bearing engagement therewith, said rolling contact element being smaller than the width of the open end of the inverted U-shaped cap means for free rolling movement therein, and spring means positioned in said casing means and above said cap means positively urging said cap means vertically downwardly against said rolling contact bearing element.

2. A weighting arm as set forth in claim 1, wherein the rolling contact bearing element is a ball.

3. A weighting arm as set forth in claim 1, wherein the rolling contact bearing element is a cylindrical roller.

4. A weighting arm as set forth in claim 1, wherein the rolling contact bearing element is a spherical roller.

5. A weighting arm as set forth in claim 1, wherein said cap means include means for controlling the effective rolling range of the rolling contact bearing element.

6. A weighting arm as set forth in claim 1, wherein the upper surface of the weighting arm includes a recess for controlling the range of movement of the rolling contact bearing element.

7. A weighting arm as set forth in claim 1, wherein the upper surface of the weighting arm includes an opening for controlling the range of movement of the rolling contact bearing element.

* * * * *